US006651273B2

(12) United States Patent
Vilsmeier

(10) Patent No.: US 6,651,273 B2
(45) Date of Patent: Nov. 25, 2003

(54) LIFT BED

(76) Inventor: Gerhart W. Vilsmeier, Bussardweg 42, Aschaffenburg 63741 (DE)

( * ) Notice: Subject to any disclaimer, the term of this patent is extended or adjusted under 35 U.S.C. 154(b) by 108 days.

(21) Appl. No.: 10/006,907

(22) Filed: Dec. 6, 2001

(65) Prior Publication Data

US 2002/0088052 A1 Jul. 11, 2002

(30) Foreign Application Priority Data

Dec. 15, 2000 (EP) ..... 00127557

(51) Int. Cl.[7] ..... A47C 17/84
(52) U.S. Cl. ..... 5/11; 5/10.2
(58) Field of Search ..... 5/11, 10.2, 10.1, 5/131, 133, 136

(56) References Cited

U.S. PATENT DOCUMENTS

| | | | | | |
|---|---|---|---|---|---|
| 652,158 | A | * | 6/1900 | Beard | 5/10.2 |
| 931,962 | A | * | 8/1909 | Rountree | 5/10.2 |
| 1,065,287 | A | * | 6/1913 | Welch | 5/10.2 |
| 1,696,412 | A | * | 12/1928 | Price | 5/10.2 |
| 3,665,527 | A | | 5/1972 | Gonzalez | 5/10 B |
| 4,837,877 | A | * | 6/1989 | Hamada et al. | 5/10.2 |
| 5,020,169 | A | * | 6/1991 | Hamada et al. | 5/10.2 |
| 5,056,170 | A | * | 10/1991 | Kronshagen | 5/10.1 |
| 5,084,924 | A | * | 2/1992 | Spitz | 5/136 |
| 5,363,520 | A | * | 11/1994 | Lyne, Jr. | 5/11 |
| 5,502,850 | A | * | 4/1996 | Lyne, Jr. | 5/11 |
| 5,943,714 | A | * | 8/1999 | Dignam | 5/11 X |
| 6,550,081 | B2 | * | 4/2003 | Vilsmeier | 5/11 |
| 2002/0046423 | A1 | * | 4/2002 | Vilsmeier | 5/11 |
| 2002/0088052 | A1 | * | 7/2002 | Vilsmeier | 5/133 |

FOREIGN PATENT DOCUMENTS

| | | | | |
|---|---|---|---|---|
| DE | 2222030 | | 11/1973 | B66F/7/28 |
| EP | 418415 | * | 3/1991 | 5/11 |
| FR | 2633814 | | 1/1990 | A47C/17/84 |
| FR | 2668348 | | 4/1992 | A47C/17/84 |
| FR | 2071028 | | 9/1994 | B66F/7/00 |
| GB | 2276315 | | 9/1994 | A47C/17/84 |

* cited by examiner

*Primary Examiner*—Robert G. Santos
(74) *Attorney, Agent, or Firm*—Darby & Darby

(57) ABSTRACT

Lift bed with a bed frame carried on at least two carriages, whereby each carriage is supported movably on a guide rail arranged vertically for moving the bed frame in the vertical direction and whereby each carriage consists of two parts which are supported in a mutually tiltable manner via a horizontal axle running parallel to the bed-frame width; the two carriage parts of each carriage are joined by an adjustment device clamping them together so that the bed frame mounted on the first carriage part is adjustable in the horizontal position; the adjustment device exhibits an overload device which gives way on reaching a predefined limit load and releases the connection and whereby also an end-stop is provided which holds the bed frame in a slightly angled position after release of the connection.

11 Claims, 6 Drawing Sheets

LIFT BED

Figures 1, 1A:
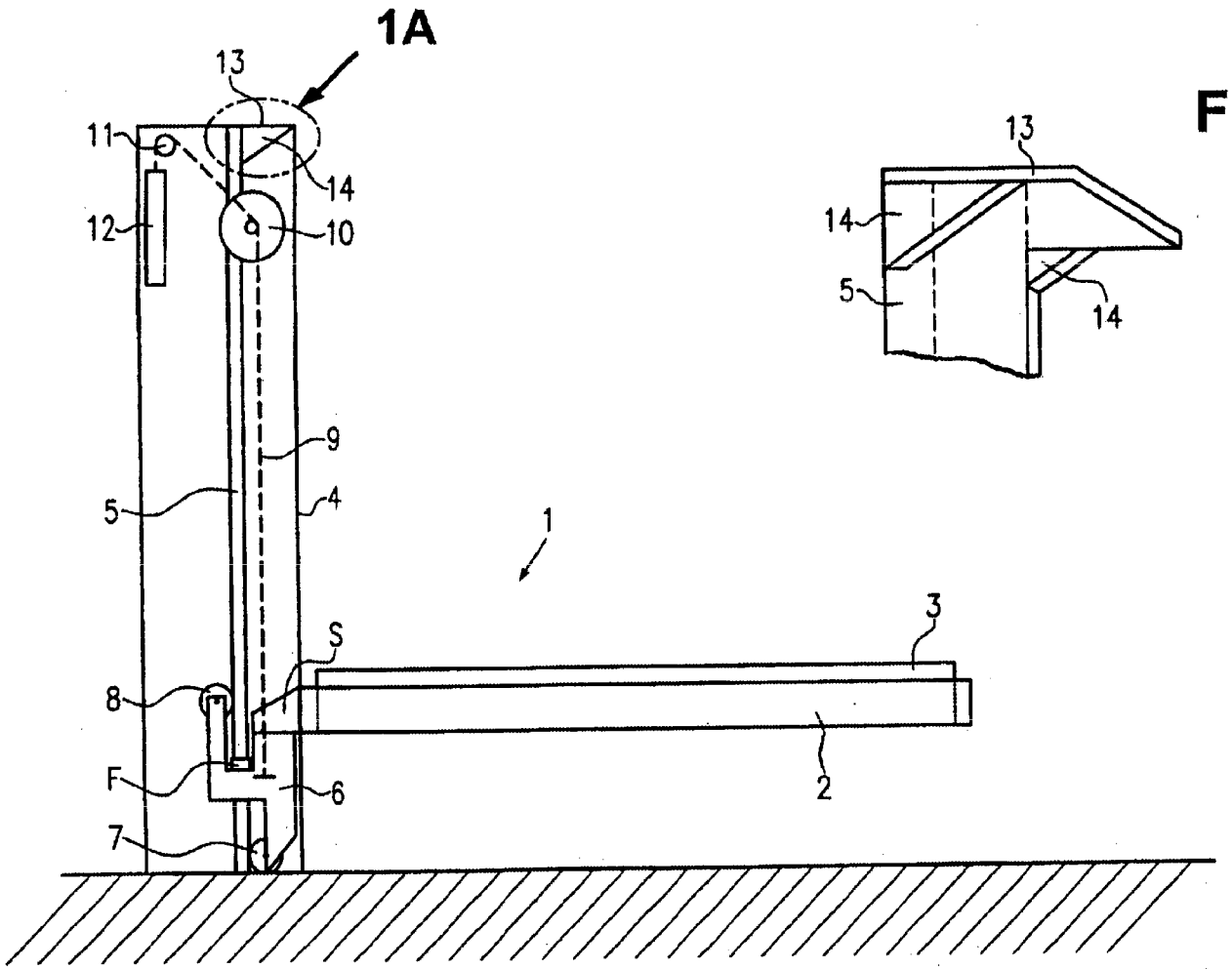

The invention refers to a lift bed according to the preambles of Patent claims 1 and 6.

From EP-B1-0 418 415 a suspended bed is known with a bed frame which can be adjusted in height and a lifting mechanism for moving the bed frame in the vertical direction. The suspended bed includes a vertically running guiding device mounted on the wall on which the bed frame is supported with one end being able to move in the vertical direction. The lifting device is provided with a self-locking drive and is formed and arranged such that it acts on the bed frame at the mentioned end.

The lifting device comprises at least one electric motor for driving lifting spindles arranged to be self-locking, whereby a crank handle is provided for emergency operation. The handle can be coupled with the lifting spindles, driving them when the crank is rotated.

Furthermore, EP-B1-0 418 415 describes an overload protection device with the aid of which deformation of the bed frame and of the guiding device is prevented when a certain load on the bed frame is exceeded.

The suspended bed described in EP-B1-0 418 415 is very space-saving and safe in operation. In particular, for the case where the lifting device is arranged in the region of the guiding device, practically no living area is taken up when the suspended bed is lifted below the room ceiling. Furthermore, the self-locking drive enables the suspended bed to be supported in any vertical position in an operationally safe manner, free of oscillations.

A disadvantage of the suspended bed according to EP-B1-0 418 415 is however that release of the overload protection device may lead to the injury of a suspended-bed user and, in particular, intensive usage of the suspended bed leads to material fatigue of this overload protection device, which can lead to unprompted release of the overload protection device.

Starting from the known prior art, the object of the invention is a lift bed which exhibits improved safety devices.

This object is realized based on the preambles in Patent claims 1 and 6 with their characterizing features.

In particular this object is realized by a lift bed with a bed frame carried on at least two carriages, whereby each carriage is supported movably on a guide rail arranged vertically for moving the bed frame in the vertical direction and whereby each carriage consists of two parts which are supported in a mutually tiltable manner via a horizontal axle running parallel to the bed-frame width. The two carriage parts of each carriage are joined by an adjustment device clamping them together so that the bed frame mounted on the first carriage part is adjustable in the horizontal position. The adjustment device exhibits an overload device which gives way on reaching a predefined limit load and releases the connection and whereby also an end-stop is provided which holds the bed frame in a slightly angled position after release of the connection.

This invention is based on the knowledge that the stated lift bed is very easy to operate and satisfies high safety requirements.

The further development according to claim 2 has the advantage that the overload protection is a shearing pin which fractures when the specified limit load is exceeded.

The further development according to claim 3 has the advantage that the end-stop is a trapping pin.

The further development according to claim 4 has the advantage that the adjustment device is a screw which is inserted into a suitable threaded hole in the second carriage part and penetrates a hole provided in the first carriage part and that the shearing pin is arranged in a hole provided in the screw and contacts the side of the first carriage part for adjustment on the side facing the bed frame.

The further development according to claim 5 has the advantage that the screw has a head section which is formed as an end-stop.

Furthermore, this object is realized by a lift bed with a bed frame supported by at least two carriages, whereby each carriage is supported movably on an associated vertical guide rail, in the region of the carriages a pulling device is arranged on each one and the pulling devices can be synchronously operated via a common operating device to move the bed frame in height without tilting to the side, whereby the carriages on the guide rails feature side guides which lead to jamming with the sidewards tilting of the bed frame due to uneven weight distribution.

The further development according to claim 7 has the advantage that the guides are each formed as a plastic block.

The further development according to claim 8 has the advantage that the guides each exhibit a coefficient of friction which is specified such that when the bed frame tilts, friction occurring between the relevant guide rail and the corresponding guide leads to jamming.

The further development according to claim 9 has the advantage that the value of the coefficient of friction is 0.35.

The further development according to claim 10 has the advantage that the guides are each formed from metal and move with a play of less than 3 mm on the corresponding guide rail.

The further development according to claim 11 has the advantage that each guide rail is toothed on the side facing the corresponding guide and locking of the relevant guide in a corresponding tooth system leads to jamming when the bed frame tilts.

Figure 2:
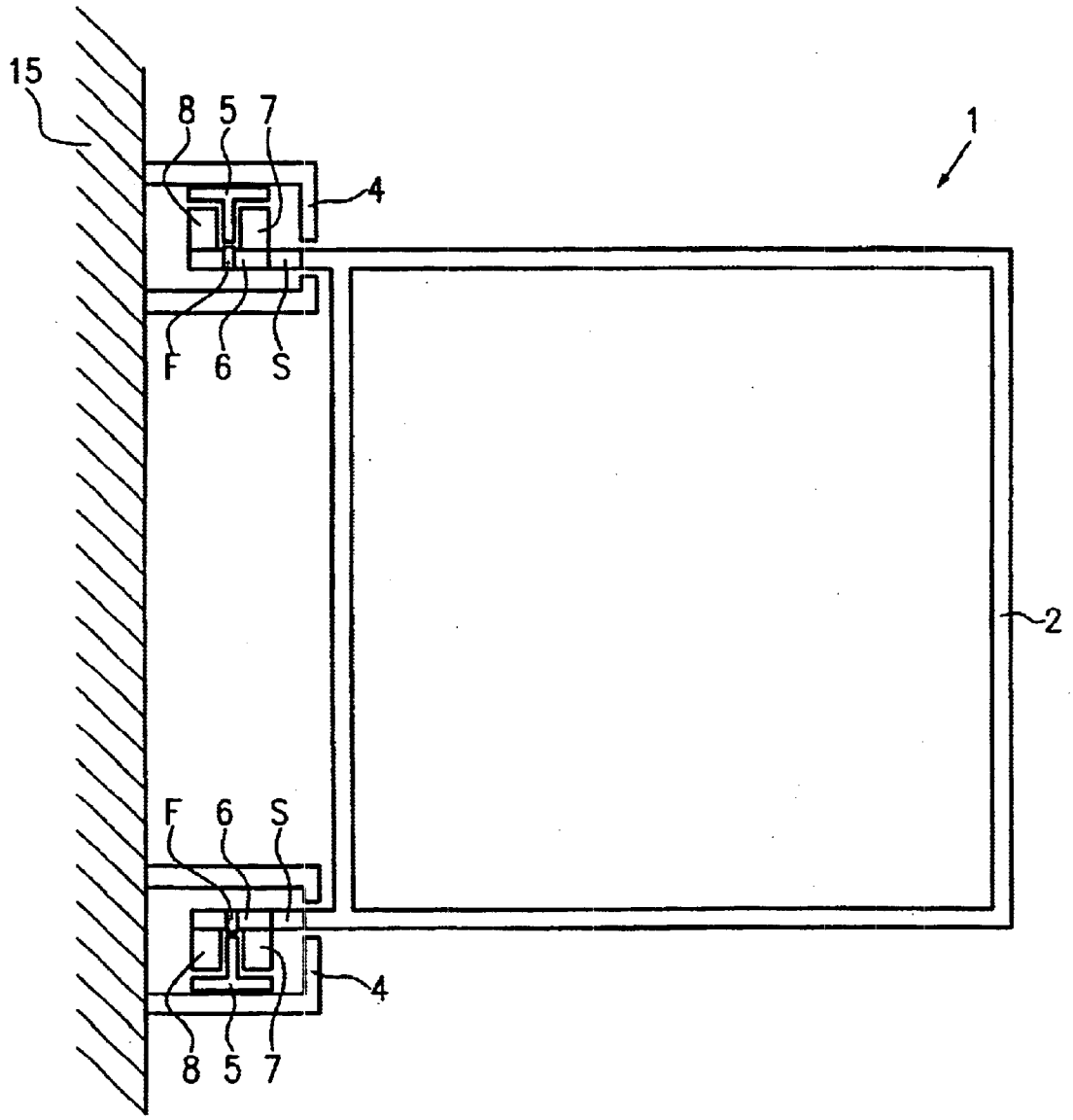
Figure 3:
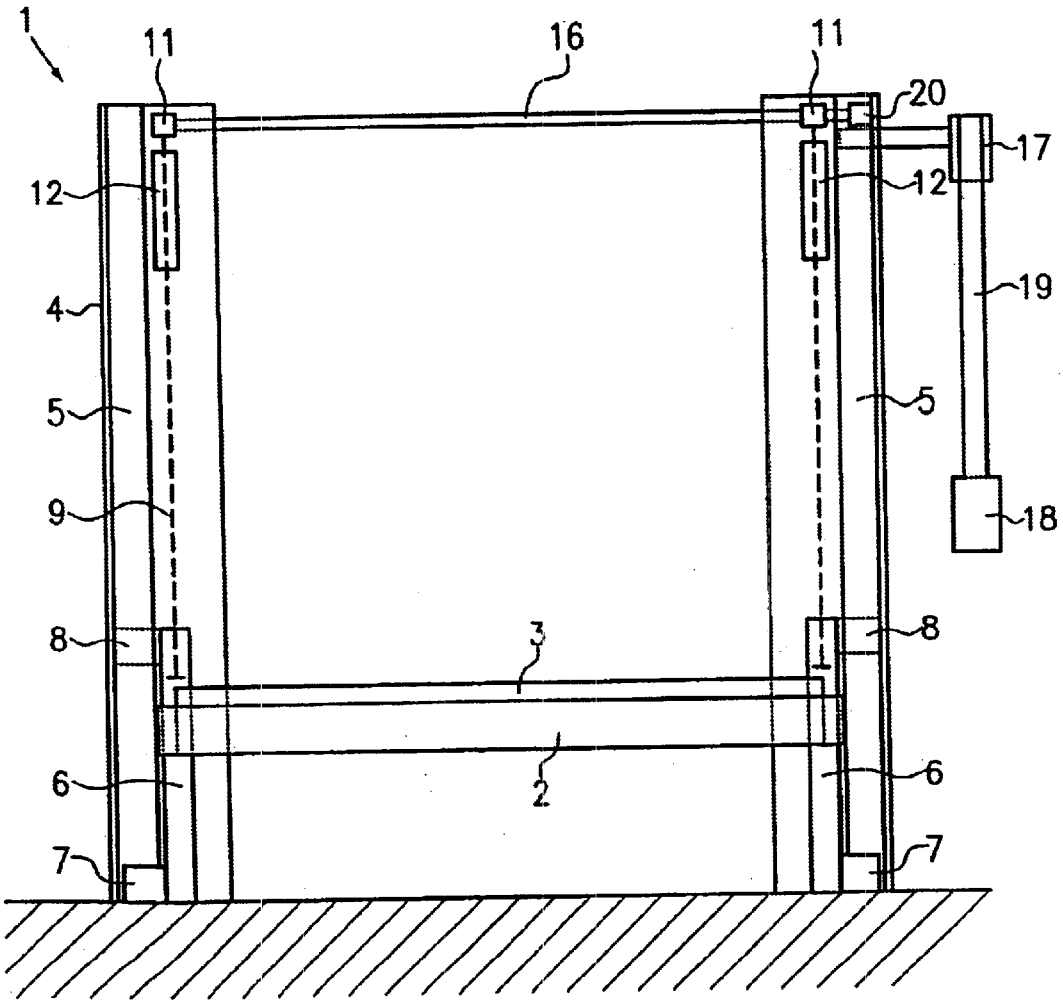
Figure 4:
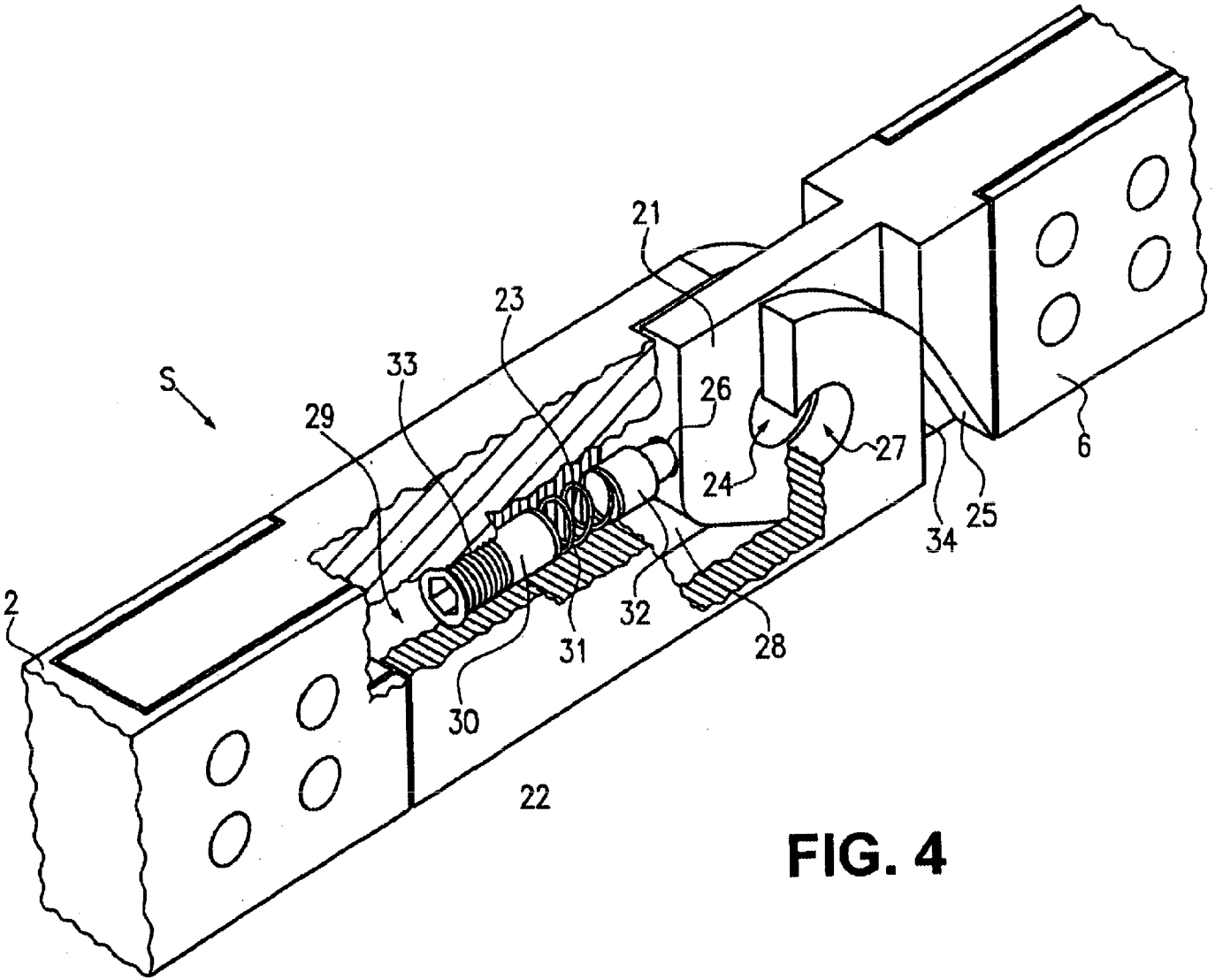
Figure 5:
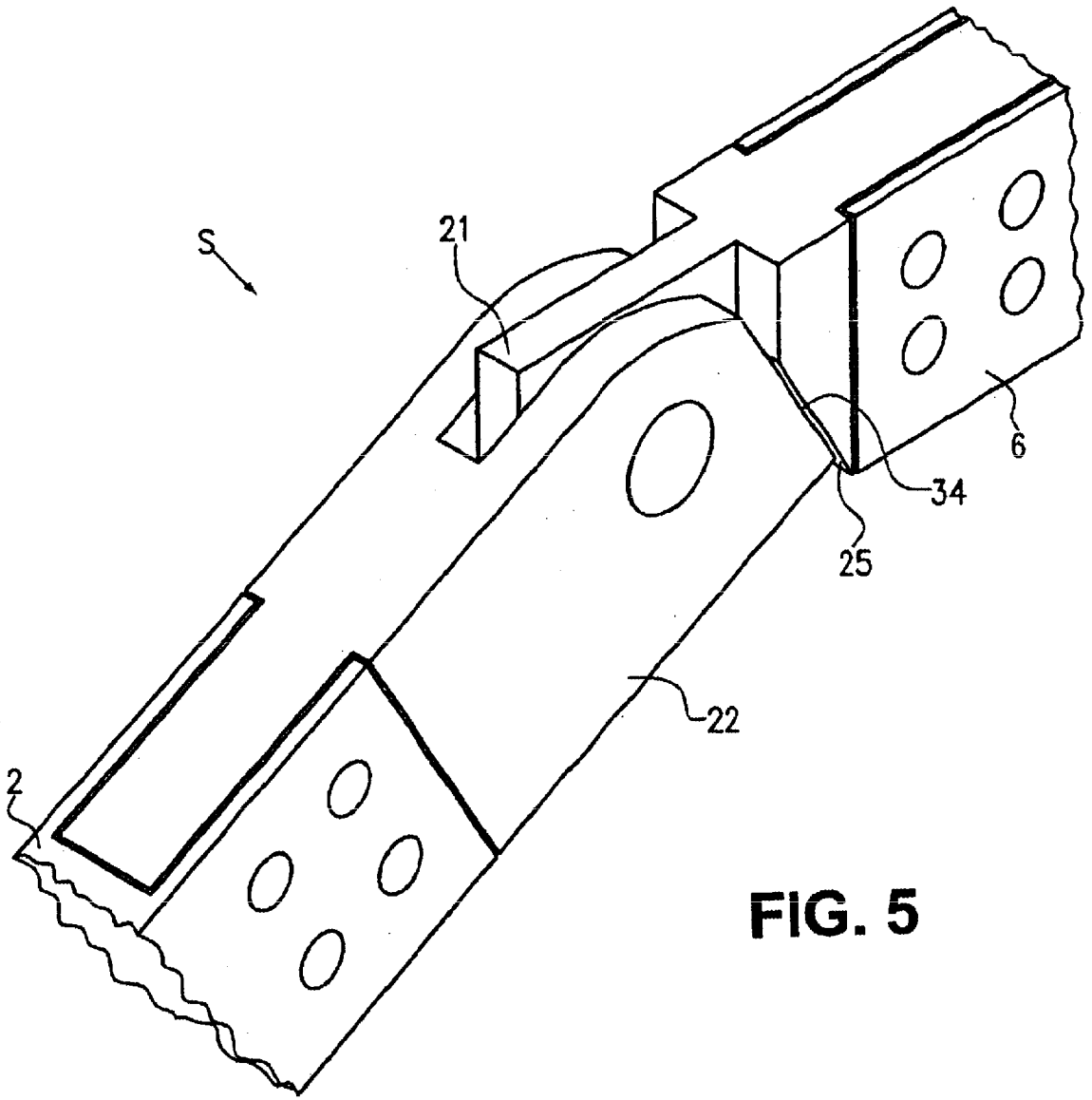
Figure 6:
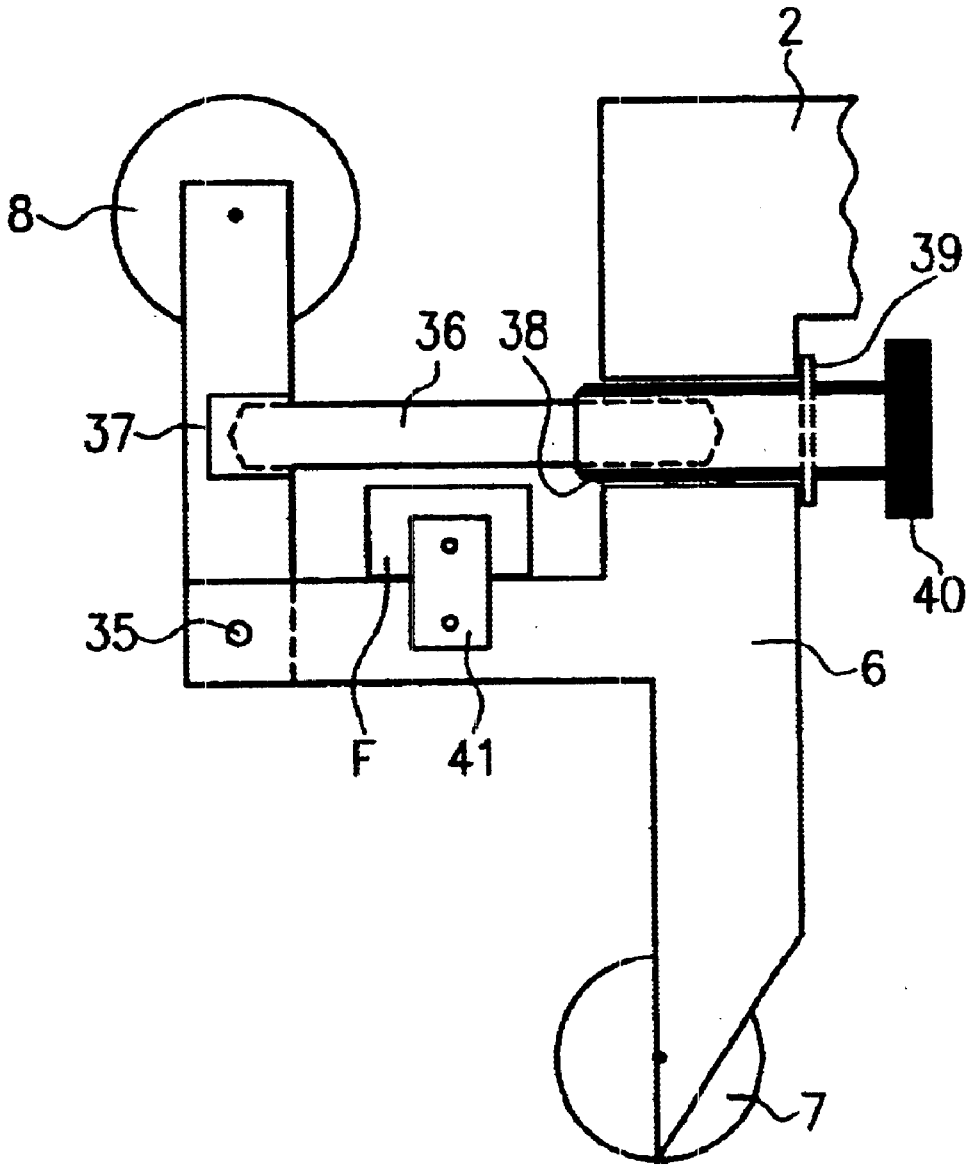

This invention is explained in more detail in the following with reference to the enclosed figures. In detail the figures contain:

FIG. 1 A schematic side view of a lift bed according to the invention;

FIG. 2 A schematic plan view of a lift bed according to FIG. 1;

FIG. 3 A schematic front view of a lift bed according to FIG. 1 with an indicated belt drive;

FIG. 4 A perspective illustration of an overload protection device according to the invention;

FIG. 5 A perspective illustration of the overload protection device according to FIG. 4 with maximum excursion; and FIG. 6 A schematic side view of a carriage according to the invention with an overload protection device.

FIG. 1 shows a schematic side view of a lift bed 1 according to the invention with a bed frame 2, a mattress 3 indicated as an example as well as a guide device 4. The guide device 4 includes a vertical guide rail 5 to which a carriage 6, that is rigidly joined to the bed frame 2, can move vertically up and down. To facilitate an up and down movement, the carriage 6 is supported movably via rollers 7 and 8 on the guide rail 5 and joined to a pulling chain 9 via a diversion roller 10 which is preferentially fitted in the vicinity of the upper end of the guide rail 5 and via a sprocket 11 with a counterweight 12. In particular the sprocket 11 can be fitted to the upper end of the guide rail, thereby taking over the function of the diversion roller 10.

According to another variant, the pulling chain 9 can be replaced by a toothed belt whereby the sprocket 11 is formed by a suitable drive wheel for driving the toothed belt.

According to a preferred embodiment of this invention, the lift bed 1 according to the invention comprises two vertical guide devices 4 which are arranged parallel to one another at a distance of a bed-frame width and preferentially are mounted on a load-bearing room wall using suitable screws. In particular the guide devices 4 are arranged with reference to the bed-frame width such that the rollers 7, 8 on the carriage 6 have a minimum play at the sides.

The carriages 6 each comprise at least one guide F on the side facing the corresponding guide rail 5 and this guide leads to jamming when the bed frame 2 is tilted sideways. Preferentially, the guide F is formed as a plastic block and consists of a strength component, a binding agent and various types of filling material which is important for the suitable adjustment of the coefficient of friction for the guide F. Asbestos fiber, asbestos cloth or steel wool can, for example, be used as strength components. Synthetic resin can be used as the binding agent. The plastic block is preferentially formed as a parallelepiped with a base side of a few centimeters.

According to a special variant of this invention, the guides can be formed from brake pads which are known in the prior art and are used, for example, in disc brakes on cars.

When the bed frame tilts, the guide F presses against the guide rail 5 with a force dependent on the weight distribution of the tilted bed frame 2. Consequently, when the bed frame 2 tilts, so much friction is created due to the predefined coefficient of friction between the relevant guide rail 5 and the corresponding guide F, that jamming is caused.

Jamming can be especially reinforced or caused by suitably forming the guide rail 5 whereby this, according to a preferred embodiment of this invention, can be toothed so that when the bed frame 2 tilts, the carriages 6 each "lock" into suitable tooth-shaped edges of the corresponding guide rail 5.

Furthermore, the bed frame 2 is implemented such that in relation to the width of the bed frame a non-uniform weight distribution is produced.

An advantage of this embodiment is that the bed frame 2 tilts and jams with an uncontrolled movement upwards or downwards, leading directly to the bed frame 2 stopping. For example, with the case that the bed frame 2 "crashes down" due to a fracture of one or both pulling chains 9, the corresponding guides tilt sideways and the bed frame 2 becomes blocked so that a fall can be prevented. Tilting and jamming is also caused when maladjustment of the pulling chains 9 occurs and the load to be raised or lowered mainly acts on one pulling chain 9 or on one side of the bed frame 2. Particularly advantageous is this type of tilting and jamming when the lift bed 1, according to the invention, is not used properly, for example, due to raising or lowering the bed frame 2 with persons on the bed.

Furthermore, a so-called safety belt, as normally found in cars, can be fitted to the bed frame 2 or at least to a carriage 6, so that the bed frame 2 falling down can be prevented by blocking the corresponding safety belt.

According to a further variant, a safety belt of this type or another belt without blocking function can be fitted to the bed frame 2 as a type of endless belt, whereby preferentially an endless belt of this type is arranged along the opening of each guide device 4, in relation to the bed frame 2, i.e. each in the area in which the bed frame 2 passes into the guide device 4. On raising or lowering the bed frame 2, the endless belt, which is carried upwards or downwards with the bed frame 2, covers the corresponding opening in the guide device 4. Furthermore, each endless belt can be guided at the side so that it is not possible to see into the corresponding guide device 4 nor "tamper" with it.

An advantage of an endless belt of this type is that a user, for example, when raising or lowering the bed frame 2 has no access to the inside of a guide device 4, so that injuries due to improper use can be prevented.

According to a further variant of this invention, a safety belt as described above or another belt without blocking function can be fitted to each carriage 6, whereby the relevant belt is tightened during winding up and unwinding due to the corresponding counterweight 12 for the case in which an endless belt is not involved. Furthermore, each endless belt can also be connected to the corresponding counterweight 12.

The guide rails 5 of the guide device 4 are preferentially each formed as T-beams which have a length corresponding to the room height. At the upper and lower ends of the T-beam a head plate 13 is mounted largely perpendicular to the side of the T-beam, which opens towards the bed frame as well as a foot plate which is not shown, which run along a load-bearing ceiling, respectively a load-bearing floor. The head plate 13 and foot plate mounted on the T-beam preferentially each have a length of 30 cm.

By fitting each guide rail 5 with a foot section of this type, it is ensured that it is almost impossible to tilt the guide rail 5 in the room, assuming that the guide rail 5 is not fixed, because by positioning the non-deformable foot section, the rotary axis lying parallel to the floor-wall edge is displaced parallel to the end of the foot section. This means however that the guide rail 5, which extends to the ceiling, can no longer tilt in the room, because, due to the displacement of the rotary axis to the end of the foot section, the head plate 13 of the guide rail 5 is pressed against the ceiling when tilted.

With this design of guide rail 5 a self-locking tilting mechanism is produced which wedges the guide rail 5 when it tilts. To prevent bending of the head plate 13 and the foot plate, two largely right-angled triangles 14 are provided for the support of each head plate 13 and foot plate, whereby the two triangles 14 are arranged at a distance corresponding to the width of the guide rail 5 so that one side of the right-angled triangle 14 is joined to the corresponding side of the guide rail 5 and the other side of the right-angled triangle 14 is joined to the head plate 13 or the foot plate. The head plate 13 or the foot plate could also though be formed uniformly with the two triangles 14.

At each of the two bed-frame corners of the bed frame 2, which are located on the wall-end of the bed frame 2, a carriage 6 is formed whereby each carriage 6 is joined via a pulling chain 9 which is joined via a diversion roller 10 and/or a sprocket 11 to a counterweight 12. The two sprockets 11 are preferentially rigidly coupled together via a coupling bar to ensure synchronous rotation of both sprockets 11.

In the embodiment illustrated in FIG. 1, the lift bed 1 is in a so-called night mode, i.e. the bed frame 2 is located near to the floor. To move the bed frame 2 vertically upwards to bring it, for example, to the highest possible vertical position, the so-called day mode, then preferentially the sprockets 11 are rotated so that the counterweights 12 move downwards in the vertical direction, whereby the bed frame 2 is moved along the guide rails 5 vertically upwards by the carriages 6. To prevent the bed frame 2 from being moved from the night mode to the day mode unintentionally, the sprockets 11 or the coupling bar can be preferentially blocked in the night mode.

For the case where the bed frame 2 is to be moved from the night mode to the day mode, the sprockets 11 are released and rotated such that the bed frame 2 moves upwards, while the counterweights 12 move vertically downwards.

The counterweights 12 are preferentially realized such that the sum of their masses is larger than the mass of the bed frame 2, so that with a release of the sprockets 11 for the case where the lift bed 1 is located in the night mode, an upwards movement of the bed frame 2 arises such that the sum of the gravitational forces acting on the counterweights 12 exceeds the gravitational force acting on the bed frame 2. Consequently, no application of force is needed, for example, by the user of the lift bed 1 to move the bed frame 2 from the night to the day mode. To move the bed frame 2 from the day mode into the night mode, an external force must act on the bed frame 2 or on the counterweights 12 so that the balance of forces described above changes in favor of the bed frame 2 so that a downwards movement of the bed frame 2 can arise.

FIG. 2 shows a schematic plan view on the lift bed 1 according to FIG. 1 for clarification of the construction of the guide devices 4. The two guide devices 4 of the lift bed 1 are mounted parallel to one another on a wall 15 at a distance which largely corresponds to a bed frame width. In each of the guide devices 4 a guide rail 5 is provided in the form of T-beam. On each of the opposite sides or legs of the T-beam the rollers 7, 8 of the corresponding carriage 6 are supported free to move, whereby both carriages 6 are mounted on two bed-frame corners of the bed frame 2, which are located on the wall end of the bed frame 2. Furthermore, each carriage 6 features a guide F which is fitted to the corresponding carriage 6 opposite the relevant T-beam foot which is vertical to the legs and is used to jam the bed frame 2 on tilting.

FIG. 3 shows a schematic front view of the lift bed 1 according to FIG. 1, including an example illustration of an example belt drive with a main winder 17, a counterwinder 18 as well as a drive belt 19 which can be used for driving or rotating the sprockets.

To move the bed frame 2 with the mattress 3 indicated as an example from the night mode illustrated in FIG. 3 to the day mode, the carriages 6 must be moved upwards in the vertical direction using the rollers 7 and 8 along the guide rails 5. This occurs by rotating the sprockets 11 so that forces act on the carriages 6 via the pulling chains 9, resulting in the desired movement.

In order that tilting of the carriages 6 on the guide rails 5 is prevented during an upwards or downwards movement of the bed frame 2, the sprockets 11 must be synchronised so that both carriages 6 are moved upwards or downwards simultaneously by identical distances. This synchronization of the sprockets 11 occurs via a coupling bar 16 through which both sprockets are rigidly coupled together. A rotation of the coupling bar 16 therefore causes a simultaneous and synchronous rotation of the sprockets 11.

According to an especially preferred embodiment of this invention, rotation of the coupling bar 16 occurs through winding up, resp. winding down of the drive belt 19 by the main winder 17. Consequently, the main winder 17 which is rigidly joined to the coupling bar 16, rotates and therefore the coupling bar 16 also rotates. Winding up and winding down of the drive belt 19 by the main winder 17 causes simultaneously a winding up and winding down of the drive belt 19 on the counterwinder 18. Rotation of the counterwinder 18 occurs preferentially using a motor with a following reduction gear.

An advantage of the application of belt drives of this type is that they are known in the state of the art and, for example, are used for room darkening devices such as roller shutters. Consequently, these belt drives can largely be procured economically, because there is an appropriately expansive series production.

There is a further advantage in the application of this belt drive, because convenient and easy operation of the lift bed 1 according to the invention is facilitated.

According to the variant illustrated in FIG. 3, the main winder 17 and the coupling bar 16 are not located at one height, so that the torque of the main winder 17 must be transferred by a diversion roller 20, indicated as an example, on the coupling bar 16. In particular a motor with appropriately low power can be used, because the forces to be applied can be minimized by the mass ratio between the counterweights 12 and the bed frame 2.

For the case that the counterweights 12 together exhibit a mass which is greater than the mass of the bed frame 2, the sprockets 11 or the coupling bar 16 must be put into rotation by the drive belt 19 in order to bring the lift bed 1 from the day mode to the night mode. To do this, the motor with the following reduction gear rotates the counterwinder 18 preferentially such that the drive belt 19 is wound off from the main winder 17 and wound onto the counterwinder 18. Consequently the winders 17, 18, the sprockets 11 and the coupling bar 16 are set rotating whereby the weights 12 are moved vertically upwards and the bed frame 2 moves downwards until it either has reached the night mode position or until the motor is switched off by a switch provided for this purpose. For the case where the bed frame 2 reaches the night mode without the motor first being switched off, the motor switches off automatically, which, for example, can be controlled via a suitable sensor, which produces a suitable control signal on detecting the bed frame 2 in the night mode position. This type of sensor or sensor system can also be used to switch off the motor when, during a downwards movement of the bed frame 2, an object is detected under the bed frame or, during an upwards movement of the bed frame 2, an object is detected on the bed frame 2. In particular the motor is realized with a reduction gear such that due to a high transmission ratio a self-locking effect can be achieved so that the bed frame 2 remains in the night mode position and preferentially only renewed activation of the motor cancels this self-locking effect.

To move the bed frame 2 from the night mode position to the day mode position, preferentially the motor with the reduction gear is switched on; then, for example, by operating a switch provided for this purpose, the drive belt 19 is released so that the bed frame 2 can move preferentially into the day mode due to the mass ratio between the counterweights 12 and the bed frame 2 without driving of the sprockets 11 by the motor being necessary.

For the case where the mass of the bed frame 2 is greater than the sum of the masses of the counterweights 12, the sprockets 11 must be set in motion by the drive belt 19 in order to move the bed frame 2 from the night mode position to the day mode position.

Preferentially the main winder 17 and the counterwinder 18 are arranged such that they can be installed inset and such that the part of the drive belt between the main winder 17 and the counterwinder 18 can be fitted freely accessible via appropriate guides for possible manual operation. Therefore, for example, in the case of a power failure the freely accessible part of the drive belt can be manually operated to move the bed frame 2 upwards or downwards in the manual mode.

FIG. 4 shows a perspective illustration of an overload protection device S according to a particularly preferential embodiment of this invention, which preferentially is located between the bed frame 2 and the carriage 6.

The overload protection device S is composed of a fixed rotating joint section 21, a swiveling rotating joint section 22 and a force transfer device 23, whereby the fixed rotating joint section 21 is mounted on the carriage 6 and the swiveling rotating joint section 22 is mounted on the bed frame.

The fixed rotating joint section 21 features a central free end and two side reinforcements each with beveled stop faces 25. The free end of the fixed rotating joint section 21 features centrally a rotating joint hole 24, whereby the lower front half of the free end is realized in a curved shape and exhibits a summit which is located on the line of symmetry of the rotating joint hole. The upper front half is realized right-angled and acts as an end-stop when the bed frame 2 is tilted up, so that it preferentially cannot be tilted higher than in a horizontal position. The end of the fixed rotating joint section 21 features an indentation 26 at the summit.

The swiveling rotating joint section 22 features at its two front ends a through joint hole 27 central to the summit of the rotating joint section and a continuously running recess central to the rotating joint part width and perpendicular to the rotating joint hole 27 corresponding to the length and width of the free end of the fixed rotating joint section 21. The recess 28 features on its inside an area which is largely shaped like the front half of the free end of the fixed rotating joint section 21, so that the swiveling rotating joint section 22 can on one hand swivel downwards, but also when tilted up, it can be blocked in an advantageous manner on meeting with the right-angled upper half of the inside area of the recess 28 against the right-angled upper half of the free end of the fixed rotating joint section 21. Furthermore, the two front ends of the swiveling rotating joint section 22 are realized such that they are each rounded at their upper ends and closed off by an area 34 which is located perpendicular to the longitudinal direction of the rotating joint section 22 and forms a right angle with the lower side of the corresponding front end.

In the installed state the free end of the fixed rotating joint section 21 is arranged in the central recess 28 of the swiveling rotating joint section 22 such that the rotating joint hole 24 of the fixed rotating joint section 21 lies concentrically to the rotating joint hole 27 of the swiveling rotating joint section 22 and these are joined together by a pin which is not illustrated. Consequently, the bed frame 2 joined to the swiveling rotating joint section 22 can be swiveled around the axis of symmetry of the two concentrically positioned rotating joint holes 24, 27.

On the inside of the swiveling rotating joint section 22 a through hole 29 is provided central to the width and height of the rotating joint section 22 and running in the longitudinal direction of the swiveling rotating joint section 22. The overload protection 23 is arranged in this through hole 29. The overload protection 23 is composed of an adjustment screw 30, a compression spring 31 and a movable body 32 which is formed as a tapered pin. The through hole 29 has a thread 33 at its rear end through which the adjustment screw 30 can be adjusted in the longitudinal direction of the through hole 29. At the front end of the adjustment screw 30 the compression spring 31 and the movable body 32 are arranged in the through hole 29. Due to the compression spring 31 between the adjustment screw 30 and the movable body 32 the latter can be moved along the through hole 29.

If the bed frame 2 is in its base position, i.e. the overload device S is not released, then the movable body 32 latches into the indentation 26 of the fixed rotating joint section 21. If a predefined force acts on the bed frame 2, pressing it down, then the movable body 32 is pressed out of the indentation 26 and pushed into the through hole 29 of the swiveling rotating joint section 22. In this way the overload protection device S releases and the bed frame 2 tilts downwards. While the bed frame 2 is tilting downwards, the movable body 32 slides on the face side of the curve-shaped free end of the fixed rotating joint section 21.

The bed frame 2 now swivels so far downwards until the surfaces 34 contact the front ends of the swiveling rotating joint section 22 on the surfaces 25 on the side reinforcements of the fixed rotating joint section 27, so that the tilting region of the bed frame 2 is restricted by the bevels of the surfaces 25.

An advantage of the overload protection device S according to the invention is that through the bevels of the surfaces 25 it can be defined how far the bed frame 2 can tilt downwards as a maximum before it reaches a stable position without any damage being able to occur to the lift bed according to the invention. A further overload of the bed frame 2 would however lead to damage to the lift bed.

A further advantage is that the upper ends of the two front ends of the swiveling rotating joint section 22 are rounded so that when the bed frame 2 is swiveled down no sharp edges arise, such as, for example, for the case where these ends are formed as right angles and on which an unsuspecting user of the corresponding lift bed might be injured.

To move the bed frame 2 into the base position again, it must be swiveled upwards until the movable body 32 again latches into the indentation 26 of the free end of the fixed rotating joint section 21.

Another advantage of the overload protection device S according to the invention is that through turning the adjustment screw 30 it can be adjusted in the longitudinal direction of the through hole 29, whereby the compression spring 31 is more or less compressed and the force at which the overload protection device trips is set.

The force at which the movable body 32 is pressed out of the indentation 26 does not depend only on the adjustment screw 30 and the compression spring 31, but also on the shape of the indentation 26. Similarly, the force required for swiveling the bed frame 2 up depends on the curve-shaped design of the free end of the fixed rotating joint section 21. Due to the curve-shaped design of the free end of the fixed rotating section 21, advantageously a substantially lower force is needed to swivel up the swiveling bed frame 2 than for releasing the overload protection device S.

FIG. 5 shows a perspective view of the overload protection device S according to FIG. 4 at maximum excursion of the bed frame 2. As can be seen from FIG. 5, the surfaces 25 of the fixed rotating joint section 21 prevent the bed frame 2 or the swiveling rotating joint section 22 from swiveling further downwards, because, when the bed frame 2 swivels down, the surfaces 34 meet the surfaces 25 and then in a preferential way lie flat on these surfaces 25, so that the swivel region of the lift bed is restricted, whereby the maximum excursion of the bed frame 2 is determined by the bevels of the surfaces 25 on the carriage 6.

In particular, FIG. 5 illustrates how the rounded upper ends of the two front ends of the swiveling rotating joint section 22 are rotated upwards when the bed frame 2 is swiveled down, whereby no sharp edges occur on which an unsuspecting user of the corresponding lift bed might be injured.

FIG. 6 shows a schematic side view of a carriage 6 according to the invention with rollers 7 and 8 and a guide F. The carriage 6 is rigidly coupled to the bed frame 2 and subdivided into two parts, which are joined to one another via an axle 35. Each of the two parts features a roller 7, 8 and the part which features the roller 8 is in relation to the part which features the roller 7, supported for tilting and in fact around an axis which runs parallel to the axle 35. The guide F is preferentially permanently joined to the part which features the roller 7 via a device 41 which is suitable for this.

Furthermore, these two parts are preferentially joined together via an adjustment device 36 through which the two parts are adjustable in relation to one another. Consequently, it can be ensured that the bed frame 2 can be aligned horizontally in relation to the floor of the room.

The adjustment device 36 is preferentially implemented as a threaded rod with counter-running threads at both ends and is at one end screwed into a thread 37 in one part of the carriage 6 and at the other end into a cylinder-shaped threaded sleeve 38 in the other part of the carriage 6. The threaded sleeve 38 features in a preferential manner a hole for accepting an overload device which is located between the threaded hole and a header part 40 of the threaded sleeve 38. The overload protection is preferentially formed as a shearing pin 39. The shearing pin 39 is implemented such that a defined limit load must be exceeded to shear or fracture it. This defined limit load is determined such that lower loads do not have any detrimental effects on the mechanism and assembly.

An advantage of the use of this type of shear pin 39 with a defined shear force is that with an overload of the bed frame 2 initially only the shearing pin shears or fractures without the lift bed itself being damaged.

For the case where the bed frame 2 becomes overloaded and the shearing pin 39 fractures for example, the two parts of the carriage 6 move vertically together by a rotation or tilting of the axis which runs parallel to the axle 35, whereby the bed frame 2 tilts downwards and the threaded sleeve 38 is pulled into the corresponding part of the carriage 6. The tilting movement is terminated by the header part 40 of the correspondingly realized threaded sleeve 40 stopping on the corresponding part of the carriage 6. Consequently, a maximum excursion of the bed frame 2 downwards can be determined by the distance between the holes for accepting the shearing pin 39 and the header part 40 of the threaded sleeve 38. The header part 40 can be realized specially as a trapping pin.

To move the bed frame 2 back into the horizontal position again, the bed frame 2 must be swiveled upwards and a new shearing pin 39 must be fitted into the holes in the threaded sleeve 38.

In particular the threaded sleeve 38 can be realized conically, whereby the diameter of the threaded sleeve 38 starting from the holes for the shearing pin 39 in the direction of the header part 40 is larger, so that when the shearing pin 39 fractures, the swivel movement of the bed frame 2 is braked such that a defined amount of friction must be overcome to pull in the threaded sleeve 38 up to the header part 40 in the corresponding part of the carriage 6.

An advantage of this type of implementation of the threaded sleeve 38 is that through a braked tilting of the bed frame 2, for example, damage to the lift bed or injury to any persons on it is avoided.

According to a further preferential embodiment of this invention, the threaded sleeve 38 and the adjustment device 36 are joined together inseparably and, for example, formed as an appropriately dimensioned screw or a cylinder-shaped bar, which only has a thread at one end. At the other end this screw or rod as header part 40 preferentially has a suitable trapping pin for trapping the tilted bed frame 2. Furthermore, the screw or cylinder-shaped bar has a hole between both ends for accepting the shearing pin 39, whereby a maximum excursion of the bed frame 2 downwards can be determined by the distance between the hole for accepting the shearing pin 39 and the trapping pin. In particular, the screw or cylinder-shaped bar and the thread 37 can be mounted directly in the assigned parts of the carriage 6 using appropriate holes or mounted to the side on the parts of the carriage 6 using suitable devices, for example.

Furthermore, the trapping pin can be realized independent of the threaded sleeve 38, screw or cylinder-shaped bar in a separate trapping device and therefore not as header part 40 of the threaded sleeve 38 or not as header part 40 of the corresponding bar or screw described above.

According to an especially preferred embodiment of the invention, the maximum excursion of the bed frame 2 should correspond to an angle of no more than 35° downwards.

What is claimed is:

1. Lift bed with a bed frame (2) carried by at least two carriages (6), whereby each carriage (6) is supported in a movable manner on an associated vertical guide rail (5) for moving the bed frame (2) in the vertical direction, characterized in that each carriage (6) consists of two parts which are supported in a mutually tilting manner by a horizontal axle (35) running parallel to the width of the bed frame, the two carriage parts of each carriage (6) are joined through an adjustment device (36) which clamps them together so that the bed frame (2) mounted on the first part of the carriage is adjustable in the horizontal position, the adjustment device (36) comprises an overload protection which gives way on reaching a defined limit load and the connection is released, and also an end-stop (40) is provided which holds the bed frame (2) in a position slightly angled after the connection is released.

2. Lift bed according to claim 1, characterized in that the overload protection is a shearing pin (39) which fractures when the specified limit load is exceeded.

3. Lift bed according to claim 1, characterized in that the end-stop (40) is a trapping pin.

4. Lift bed according to claim 2, characterized in that the adjustment device (36) includes a screw which is inserted into a suitable threaded hole (37) in the second carriage part and penetrates a hole provided in the first carriage part and that the shearing pin (39) is arranged in a hole provided in the screw and contacts the side of the first carriage part for adjustment on the side facing the bed frame (2).

5. Lift bed according to claim 4, characterized in that the screw has a head section which is formed as an end-stop (40).

6. Lift bed with a bed frame (2) carried by at least two carriages (6), whereby each carriage (6) is supported in a movable manner on an associated vertical guide rail (5), a pulling device (9) is arranged in the region of the carriages (6), and the pulling devices (9) can be operated synchronously via a common operating device (6, 17, 18, 19, 20) to move the bed frame (2) in height without sideways tilting, characterized in that the carriages (6) on the guide rails (5) feature side guides (F) which, when the bed frame (2) is sideways tilted, lead to jamming due to unequal weight distribution.

7. Lift bed according to claim 6, characterized in that the guides (F) are each formed as a plastic block.

8. Lift bed according to claim 6, characterized in that the guides (F) each exhibit a coefficient of friction which is specified such that when the bed frame (2) tilts, friction occurring between the relevant guide rail (5) and the corresponding guide (F) leads to jamming.

9. Lift bed according to claim 8, characterized in that the value of the coefficient of friction is 0.35.

10. Lift bed according to claim 9, characterized in that the guides (F) are each formed from metal and move with a play of less than 3 mm on the corresponding guide rail (5).

11. Lift bed according to claim 10, characterized in that each guide rail (5) is toothed on the side facing the corresponding guide (F) and locking of the relevant guide (F) in a corresponding tooth system leads to jamming when the bed frame (2) tilts.

* * * * *